US005242354A

United States Patent [19]

Seith, Jr.

[11] Patent Number: 5,242,354

[45] Date of Patent: Sep. 7, 1993

[54] EXERCISE GLIDER

[75] Inventor: William F. Seith, Jr., Staunton, Va.

[73] Assignees: Economy Furniture Industries, Austin, Tex.; The American Glider Company, Staunton, Va.

[21] Appl. No.: 846,137

[22] Filed: Mar. 5, 1992

[51] Int. Cl.[5] ..... A63B 21/055

[52] U.S. Cl. ..... 482/130; 482/112; 482/133; 482/135; 5/103; 5/124

[58] Field of Search ..... 482/112-113, 482/121-130, 142, 133-138; 297/264, 267, 268, 272; 5/103, 127

[56] References Cited

U.S. PATENT DOCUMENTS

| | | | |
|---|---|---|---|
| 217,918 | 7/1879 | White | 482/130 |
| 663,685 | 12/1900 | Schnacht | 5/103 |
| 1,275,757 | 8/1918 | Rosenberg . | |
| 1,885,663 | 11/1932 | Williams . | |
| 1,974,396 | 9/1934 | Wolf . | |
| 2,037,333 | 4/1936 | McGowan . | |
| 2,179,395 | 11/1939 | Yerrick | 5/124 |
| 2,634,793 | 4/1953 | Petersen | 5/103 X |
| 2,893,736 | 7/1959 | Tesi | 482/123 X |
| 2,959,210 | 11/1960 | Pearlstine . | |
| 3,325,137 | 6/1967 | Knudsen | 482/142 X |
| 4,508,341 | 4/1985 | Carrington | 482/130 X |
| 4,645,197 | 2/1987 | McFee | 482/130 X |
| 4,678,187 | 7/1987 | Prsala | 482/130 |
| 4,700,946 | 10/1987 | Breunig . | |
| 4,793,009 | 12/1988 | Degen . | |

FOREIGN PATENT DOCUMENTS

| | | | |
|---|---|---|---|
| 604340 | 5/1960 | Italy | 482/123 |
| 1437045 | 11/1988 | U.S.S.R. | 482/113 |

*Primary Examiner*—Robert Bahr
*Attorney, Agent, or Firm*—Dowell & Dowell

[57] ABSTRACT

An exercise glider has its motion resisted by a spring mechanism cooperatively associated with a friction damping mechanism. In one embodiment, the damping mechanism may be varied.

9 Claims, 4 Drawing Sheets

EXERCISE GLIDER

FIELD OF THE INVENTION

This invention relates to the health and sense of well-being of people of all ages, especially the aged and those having a sedentary lifestyle. More particularly it relates to a glider type support designed to permit the user to exercise the lower body in a progressive manner according to the individual's needs and desires.

BACKGROUND OF THE INVENTION

A decrease in lower body and leg strength is a common medical finding in the aged, in patients restricted by arthritis or other medical illnesses, and in any person with a sedentary lifestyle.

Lower body weakness results in fatigue on walking and climbing, and increase the risk for injury and falls. Weak legs contribute to lower back instability, chronic back pain, and a cycle of inactivity and depression.

Strength is a function of exercise. A recent study showed that even in the very elderly, leg strength could be greatly improved with a program of regular exercise. The same study also showed, however, that all gains in leg strength were lost within two weeks when exercise was discontinued.

Low back and leg strength can only be maintained with regular exercise, and that exercise must be continued indefinitely.

Thus, there is need for a device for safe and effective lower body exercise and that is particularly suitable, but not limited for use by, any sedentary person, specifically those with arthritis, heart disease, or any similarly restricting medical condition. Such device should offer an attractive method of regaining and maintaining lower body and leg strength, and a general feeling of well-being for persons of all ages.

In order to meet the foregoing requirements, the device should have the following attributes:

a. Suitable for all family members;
b. Useable independently of the weather;
c. Provide an increase in knee strength and stability;
d. Strengthen and tone the leg and hip muscles;
e. Increase endurance for walking or climbing;
f. Contribute to neck and lower back stability;
g. Suitable for those with poor vision or sense of balance;
h. Suitable for those with weak or painful backs;
i. Require minimal cardiovascular effort;
j. Permit the user to be seated thereby avoiding a rise or fall in blood pressure; and
k. May be varied or stopped at any time.

In addition, the device should be suitable under medical conditions such as arthritis, osteoporosis, after surgery, chronic back, hip or leg weakness and during convalescence from medical illness or treatment. Such device should also provide relaxation, reactivation and stress management of the individual.

HISTORY OF THE RELATED ART

Gliders with spring stabilizers have been known in the prior art as for example in the United States patents to Williams U.S. Pat. No. 1,885,663, Wolf U.S. Pat. No. 1,974,396, McGowen U.S. Pat. No. 2,037,333, and Pearlstein U.S. Pat. No. 2,959,210.

A child's amusement device that functions similarly to a glider and with springs at the front and rear is shown in the U.S. Pat. No. to Rosenberg 1,275,757.

The U.S. Pat. No. to Breunig 4,700,946 discloses an exercise device which allows the user to exercise against a resistance proportional to his own weight. Thus in column 4, lines 42–58, is a statement that a bar may be so mounted that the user may push the user support assembly up inclined tracks in order to exercise.

The U.S. Pat. No. to Degen 4,793,009 discloses a mounting for a bed which permits it to oscillate and in FIG. 8 discloses a damping arrangement.

SUMMARY OF THE INVENTION

It is an object of the invention to provide an exercise glider to meet the needs and having the attributes discussed in the foregoing background section.

It is a further object of the invention to provide an exercise glider in which provision is made for adding resistance to the motion of the chair, thereby creating a chair with dual usage, that is for relaxation and as an exercise machine.

It is a further object of the invention to provide an exercise glider in which a seated person pushing backward with his legs must overcome a spring resistance, and thereby accomplishes an exercising function.

A further object is a provision of a friction damping mechanism which is associated with the resistance mechanism of the chair to reduce the rate of the glider return, thereby modifying the exercise dynamics.

It is a further object of the invention to provide a resistance to the chair movement which also affords self-centering of the chair on its base.

A further object of the invention is an exercise glider in which the resistance to motion is progressive in order that the user may adapt it to his own needs, either for exercising or merely for relaxation.

These and other objects of the invention will become apparent from the following description in conjunction with the accompanying drawings.

DESCRIPTION OF THE PREFERRED EMBODIMENT

Figure 1:
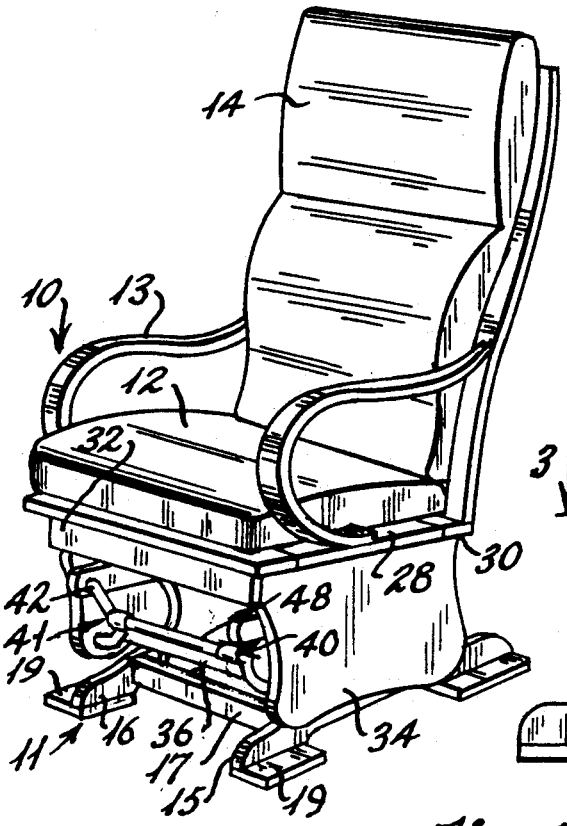
FIG. 1 is a perspective of an exercise glider in accordance with the present invention.
Figure 2:
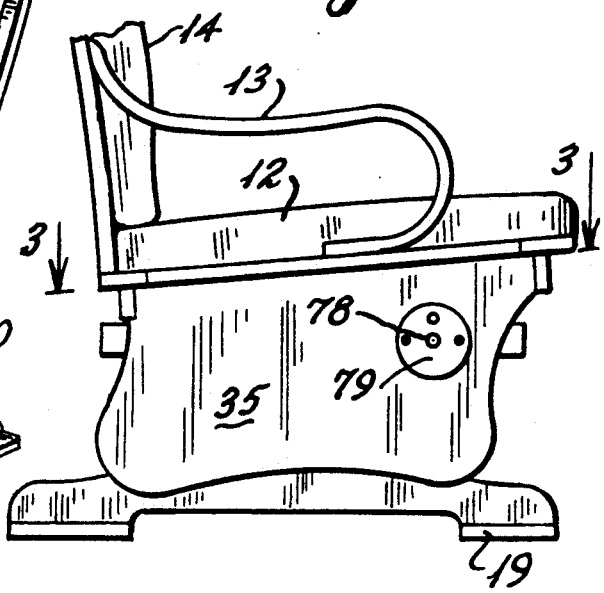
FIG. 2 is a side elevation.
Figure 3:
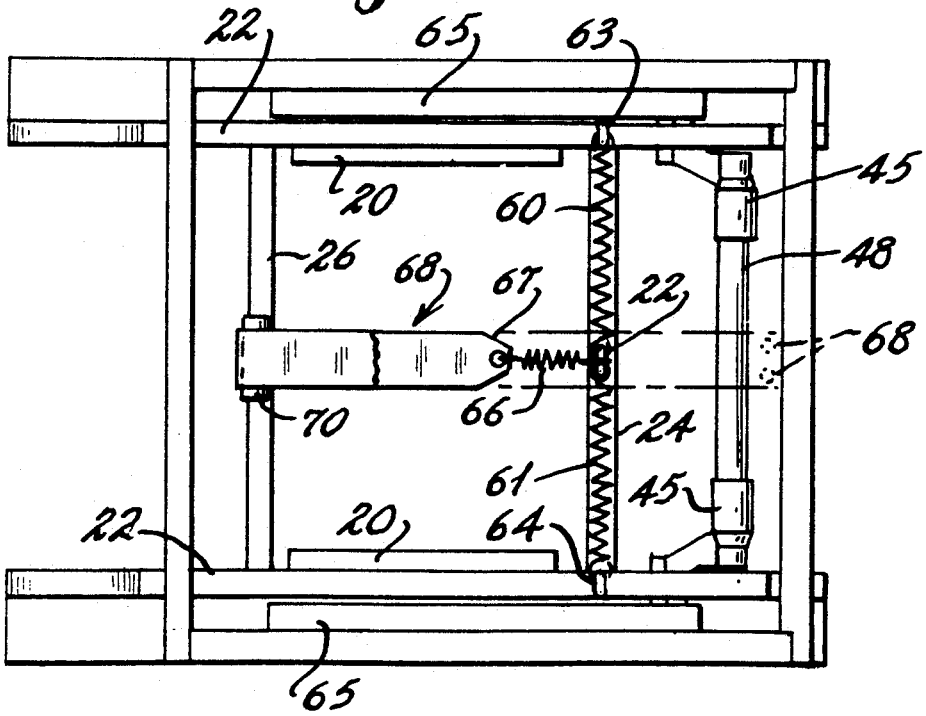
FIG. 3 is a section on the line 3—3 of FIG. 2, with portions omitted for clarity.
Figure 4:
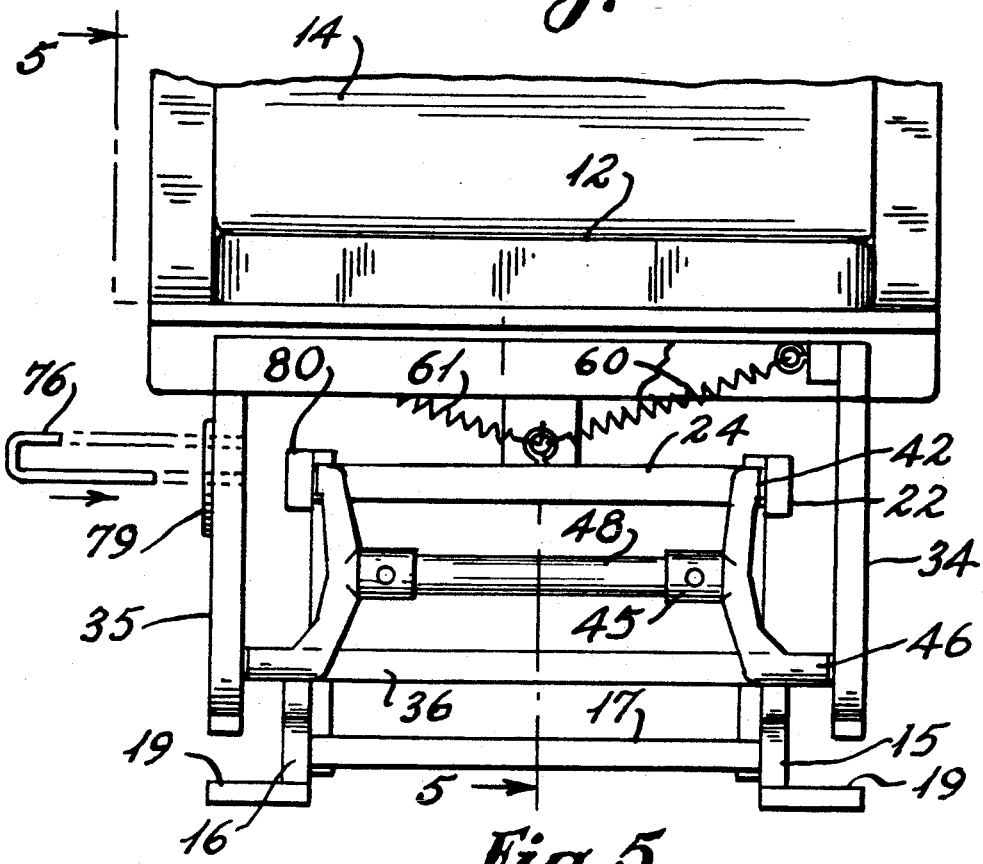
FIG. 4 is a front elevation with portions broken out to show the spring mounting.

With further reference to the drawings, the exercise glide of the present invention includes a seat support assembly 10, base assembly 11, a seat pad 12, arms 13, and back 14. These are constructed and arranged so as to provide optimal comfort and support for a user of the chair.

The base assembly 11 has left and right foot members 15, 16 connected by front and rear crossbars 17 and 18. The foot members 15 and 16 are preferably provided with plates or outriggers 19 for the purpose of further stabilizing the chair, particularly against tilting.

At the upper central portion of each of the foot members a side plate 20 is mounted and extends upwardly for connection to a side rail 22, the side rail extending substantially parallel with the foot members 15, 16 and longitudinally of the chair.

The side rails 22 are connected by crossbar 24 at their forward portion forwardly of the side plate member 20, and by a crossbar 26 which is positioned rearwardly of the side plate member 20.

The base structure described thus far including the foot members, the upright side plate members 20, the rails 22, and the crossbars 24, 26, comprise a fixed rigid assembly.

The seat support assembly 10 includes a horizontal frame portion having side members 28 and front and rear cross members 30 providing a frame on which the cushion is mounted. Extending downwardly from the cross member 30 are front and rear aprons 32, 33. Side panels 34, 35 extend downwardly from the left and right side members 28 and are connected together, just above the foot members 15 and 16, by crossbars 36, 37.

In order to mount the seat support assembly on the base assembly, a rocker arm assembly is provided.

The rocker arm assembly includes front rocker arms 40, 41 each of which has an upper crank arm 42 that is received in a roller bearing 43 in the side rail 22 of the base assembly. Each of the rocker arms is substantially U-shaped and has a web portion 44 with a central hub 45. The lower portion of each of the rocker arms has a crank arm 46 that is received in a roller bearing 47 in a side member 32 of the chair seat support. The hubs 45 are rigidly joined by connector 48. Similarly, at the rear of the chair, the rocker arms 51 have crank arms 52 received in a bearing 53 in the base assembly, the other crank arm 55 being received in a bearing 56 in the side member of the seat assembly, the rear rocker arms being joined by connector 58.

In accordance with the structure described thus far, the base assembly side rail 22 rotatably supports the upper crank arms of the front and rear rocker arms, the lower crank arms being rotatably received within the side panels 34, 35 of the seat support assembly 10, thus permitting the chair to glide back and forth with a rocking motion.

In order to modify the exercise dynamics in accordance with the present invention, a spring and damper assembly is provided. The spring assembly includes a coil spring assembly 60, 61 having an end of each attached centrally to an eyebolt 62 which is mounted on the base assembly crossbar 24 and extending just above said rail. At its outer ends the spring 60, 61 are connected to eyebolts 63, 64 which are mounted on the inner sides of side rails 65 of the seat assembly 10.

A damper assembly is provided to dampen the return of the seat after its rearward movement. This includes a relatively light take-up spring 66 which is connected at one end to a forward central portion of the base, such as to the eyebolt 62, and at its other end to the end 67 of a belt 68, the belt passing around the crossbar 26 and then returning above its lower run to a fastener 68 just beneath the seat front cross member 30 where its front end is connected. Crossbar 26 preferably is round and has a polished sleeve 70 around the portion thereof which the belt 68 engages in order to reduce the friction and the noise associated with the rubbing of the belt around the crossbar. It is understood that the material of the belt, its frictional characteristics, and those of the sleeve 70 may be selected to produce the desired dampening effect, in accordance with the needs of the users of the device.

Figure 10:
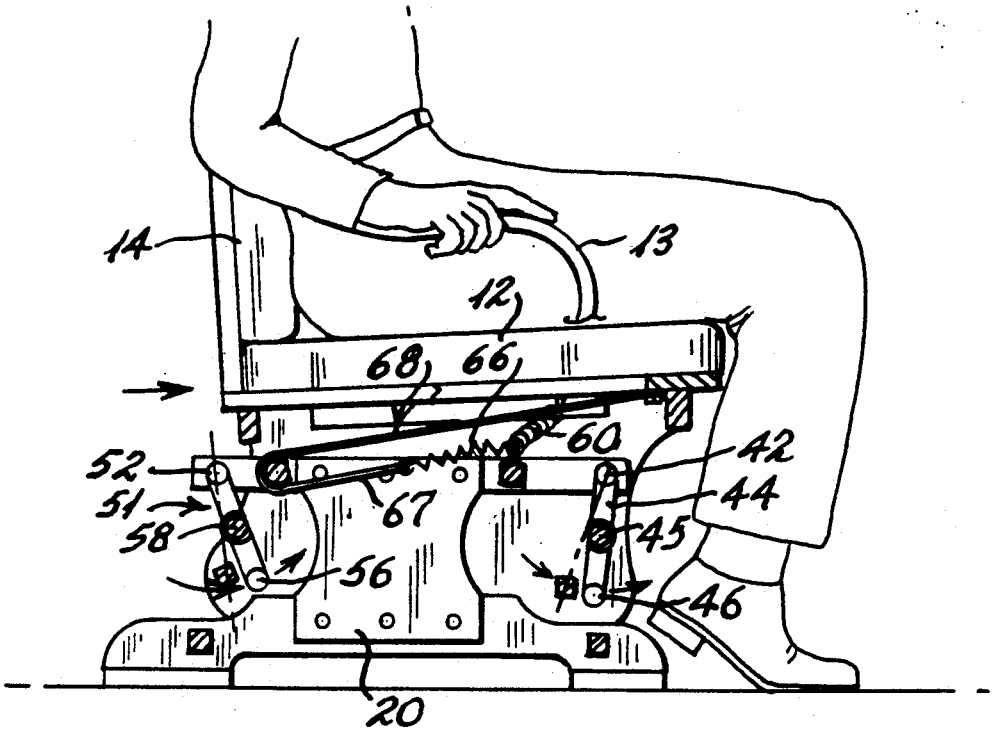
FIG. 10 is a side elevation with parts broken out illustrating the manner of use when the seat is in a forward position.
Figure 9:
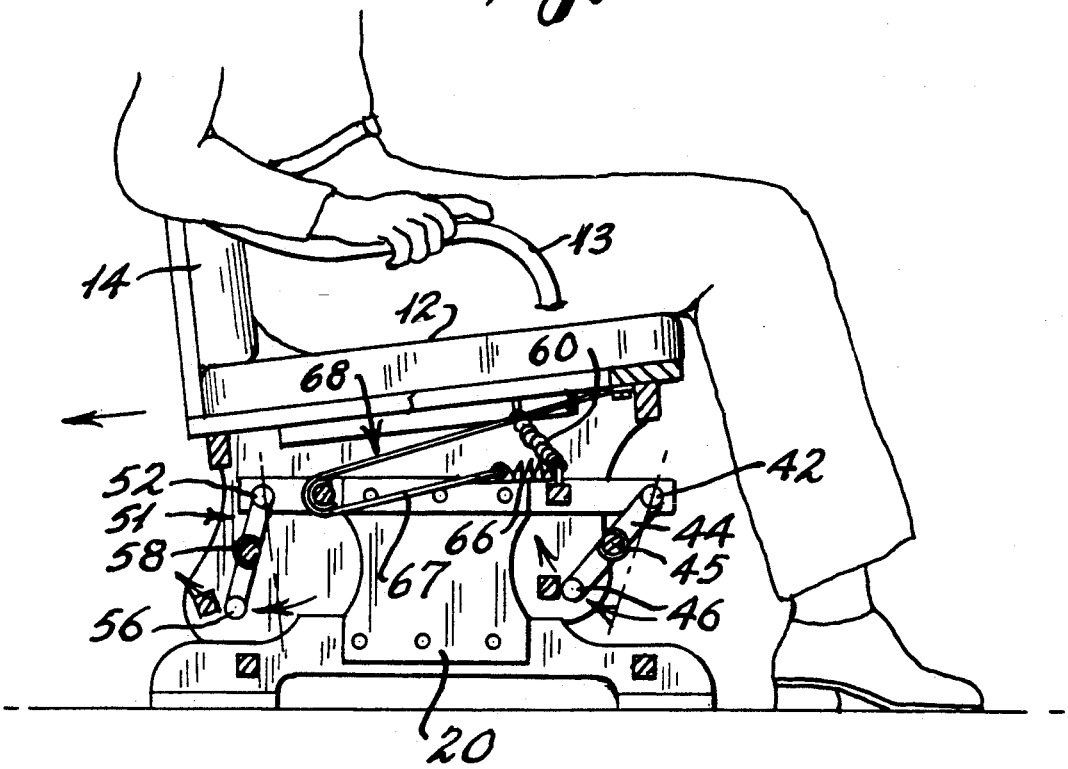
FIG. 9 is a side elevation with parts broken out illustrating the manner of use when the seat is in a backward position.

The tension of the spring 60, 61 may be selected so as to require a reasonable amount of effort from a sedentary person to move the seat backwardly when he pushes his feet against the floor. The tension in the take-up spring 66 is such as to maintain the belt 68 in contact with the sleeve 70 so that the desired damping action is obtained. It is understood that the chair may be used for exercise not only by pushing rearwardly but also by pulling forwardly as indicated in FIGS. 9 and 10.

It will also be understood that blocks or boxes may be placed under the user's feet in order to elevate them in order to vary the positioning of the user's body.

In the operation of the chair as thus described, a person initially pushes or pulls with his feet against the floor in order to move the chair rearwardly or forwardly against the tension of the springs 60, 61. After the chair has reached the extent of the its movement as caused by the person using the chair, then the springs tend to return it to its initial at rest or dead center position. However, a simple oscillating motion due merely to the springs is prevented by reason of the damping mechanism that has been described. Thus, a person may obtain the desired amount of exercise through the use of the chair.

Figure 5:
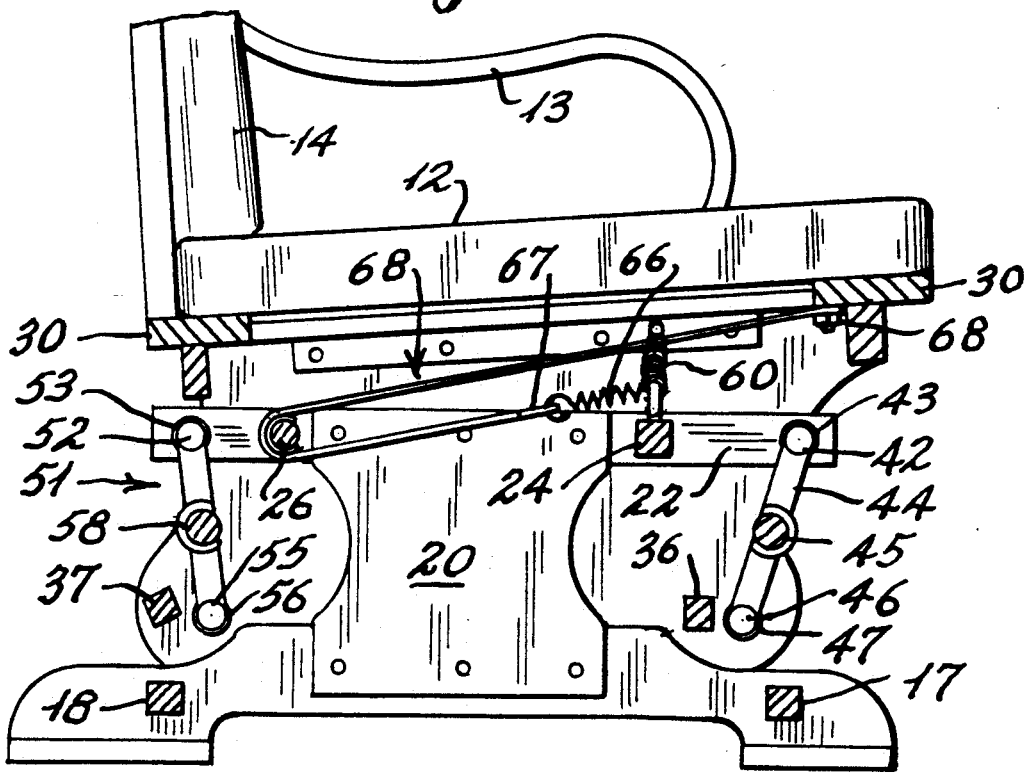
FIG. 5 is a section on the line 5—5 of FIG. 4.

In the event that it is desired to lock the chair seat against backward and forward movement, as for shipment, or in the event that no movement is desired, then a rod member 76 (see FIG. 5) is inserted through an aperture 78 in a disk 79 mounted on the right side of the chair assembly, the rod extending through the opening 78 into an aligned opening 80 which i in the side rail 22 of the base assembly.

THE MODIFICATION OF FIGS. 6-8

Figure 6:
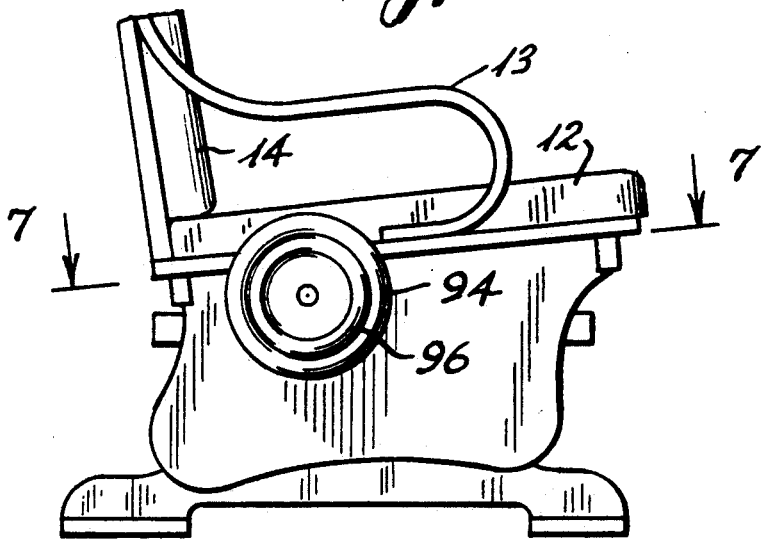
FIG. 6 is a side elevation of a modification showing apparatus for adjustment of the damper belt.
Figure 7:
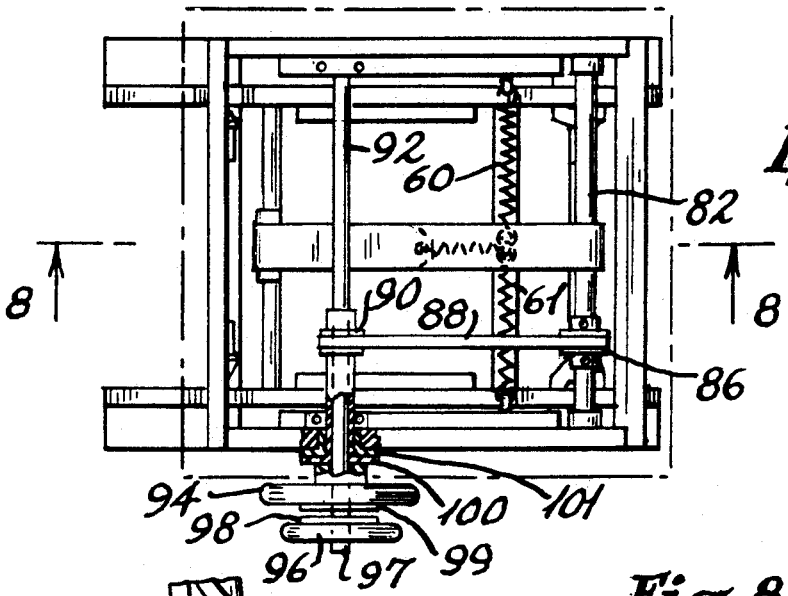
FIG. 7 is a section on the line 7—7 of FIG. 6.
Figure 8:
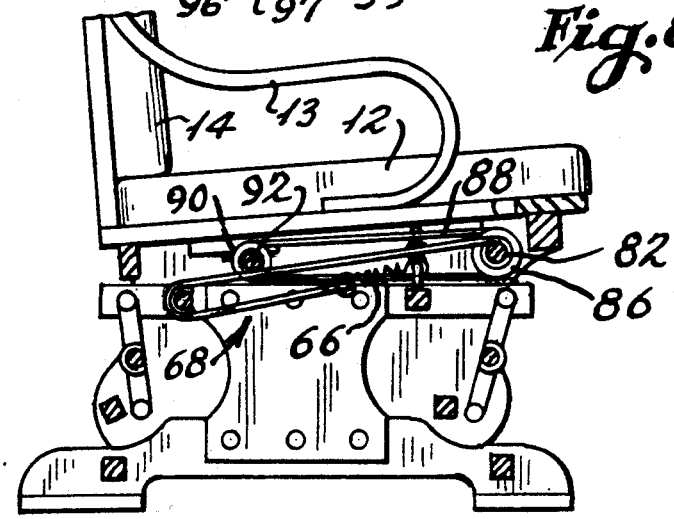
FIG. 8 is a section on the line 8—8 of FIG. 7.

The modification of FIGS. 6-8 is for the purpose of permitting adjustment of the tension on the damper belt 68. This is accomplished by providing a roller bar 82 which is rotatably carried in the side panels 34, 35 just beneath the seat frame. The bar has a sheave 86 over which a belt 88 is engaged and engages a rear sheave 90 which is mounted on a roller bar 92 which is also rotatably carried in the side panels beneath the frame of the seat at its rearward portion. The roller bar 92 is connected to a handwheel 94 on the outside of the chair for convenient use by a user in order that rotation of the wheel 94 will turn the roller bar 82 on which the end of the belt 68 is mounted, thereby wrapping the belt onto the bar and effectively decreasing its length. The position of the wheel 94 and, hence, of the belt may be secured by a locking wheel 96 which is threaded onto a shaft 97 which extends inside the bar 92 and is fixed at its other end to the panel 35.

Wheel 94 has a friction collar 98 on its inner side for engaging a friction collar 99 on the outer side of the handwheel 94 when the wheel 96 is moved towards the wheel 94. The inside face of the wheel 94 ma also have a friction collar for engaging a friction collar 101 that is fixed to the outside of the panel 34 so that the tightening of the wheel 96 may force the wheel 94 inwardly against the collar and thereby fix its position.

I claim:

1. An exercise glider comprising a base, seat support means, means mounting said seat support means for forward and rearward motion on said base, spring means interconnecting the base and the seat support means, said spring means mounted centrally of the seat support means and connected to the opposite sides of the base, said spring means resisting the movement of said seat support means in a rearward direction from a first dead center position to a second position and in a forward direction from said first dead center position to a third position, and urging the return of said seat support means from said second or third position to said dead center position, said spring means resisting the forward and rearward movement of the seat support means from dead center substantially equally, said resistance progressively increasing from a minimum with the distance moved in either direction, and damper means resisting the movement of said seat support means in a forward direction and slowing the return of said seat support means from said second position to said first position.

2. The glider of claim 1, in which said means mounting said seat support means comprises rocker arms swingably supporting said seat support means.

3. The glider of claims 2, in which cooperating pairs of front and rear rocker arms have an upper crank arm rotatably connected to said base, and a lower crank arm rotatably connected to said seat support means.

4. The glider of claim 1, which said spring means comprises a pair of springs, one end of each spring being mounted substantially centrally of said base, the remote ends of said springs being connected to opposite sides of said seat support means.

5. The glider of claim 1, in which said damper means comprises a belt connected to a take-up spring, one end of said belt being connected to the front of said seat support means, the other end of said belt being connected to an end of the take-up spring, the other end of the take-up spring being connected to a forward portion of said base, and a post at the rear of the base, said belt passing around said post and being held in engagement with it by said take-up spring.

6. The glider of claim 5, and a sleeve around said post over which said belt passes for varying the frictional engagement between the belt and the post.

7. The glider of claim 5, and means for adjusting the length of said damper means in order to vary its damping effect.

8. The glider of claim 7, in which a roller bar is rotatably mounted on said seat support means, said one end of said belt being wrapped onto said roller bar, and means mounted on said seat support means for turning said roller bar to vary the length of said damper means and for fixing the rotative position of said roller bar.

9. The glider of claim 1, and rod means selectively moveable to interconnect said seat support means and said base in order to prevent relative motion therebetween.

* * * * *